US005534320A

United States Patent [19]

Raby

[11] Patent Number: 5,534,320

[45] Date of Patent: Jul. 9, 1996

[54] ID CARDS FOR IMPACT AND NON-IMPACT PRINTERS

[75] Inventor: James M. Raby, Niagara, N.Y.

[73] Assignee: Moore Business Forms, Inc., Grand Island, N.Y.

[21] Appl. No.: 260,788

[22] Filed: Jun. 16, 1994

Related U.S. Application Data

[62] Division of Ser. No. 38,632, Mar. 29, 1993, Pat. No. 5,413,532.

[51] Int. Cl.[6] ..... B41L 1/20

[52] U.S. Cl. ..... 428/42.1; 40/625; 40/626; 40/630; 283/81; 283/101; 283/106; 283/109; 428/42.2; 428/42.3; 428/187; 428/195; 428/212; 428/214; 428/220; 428/914

[58] Field of Search ..... 428/40, 41, 42, 428/195, 187, 212, 214, 220, 914; 283/81, 101, 106, 109; 40/630, 625, 626

[56] References Cited

U.S. PATENT DOCUMENTS

| | | | |
|---|---|---|---|
| 3,581,417 | 6/1971 | Andrews | 283/108 |
| 4,158,587 | 6/1979 | Keller | 428/40 |
| 4,544,590 | 10/1985 | Egan | 428/40 |
| 5,209,514 | 5/1993 | Hebert | 428/42 |

*Primary Examiner*—Nasser Ahmad
*Attorney, Agent, or Firm*—Nixon & Vanderhye

[57] ABSTRACT

An identification card assembly, made from an intermediate, comprises a carrier sheet with at least one ID card mounted on, and having smaller dimensions than, the carrier sheet. The ID card is connected to repositional adhesive, which in turn is connected through a tie coat to paper label stock, in turn connected by permanent adhesive to the paper carrier sheet. The assembly is constructed from an intermediate which includes a roll of release material on which are provided a number of spaced ID cards and associated adhesive. The carrier sheet is fed through a non-impact printer for variably imaging indicia on the top face of the ID card. A carrier sheet can be made into a mailer.

17 Claims, 2 Drawing Sheets

ID CARDS FOR IMPACT AND NON-IMPACT PRINTERS

This is a divisional of application Ser. No. 08/038,632, filed Mar. 29, 1993, now U.S. Pat. No. 5,413,532.

BACKGROUND AND SUMMARY OF THE INVENTION

The conventional technique for manufacture of identification cards for both non-impact and impact printers (that is in which the variable indicia, such as the customer's name and account number, are printed on the ID cards) is laminating a desired face stock coated with an adhesive to a special film. The film is coated on one side with an aliphatic polyurethane, and on the other side with a permanent adhesive and release liner. This construction is then put on a press such as Webtron 1600, and printed, die cut, matrix stripped, slit, and rewound. The cards are then tipped on or blown on to a carrier sheet, and variable printing can be applied when they are on the carrier sheet. When the cards are removed from the carrier sheet, the adhesive layer (in contact with the card) also removes the aliphatic polyurethane layer, which deactivates the adhesive. However when the ultimate user of the ID card handles it in normal use, the polyurethane layer abrades, and the adhesive comes through in spots so that the card becomes sticky.

In another conventional technique, a hot melt or cold latex glue is used to adhere the ID card to a carrier. As the carrier with attached card travels through a roller nip, around a roller, or the like, the card may unseat from the carrier. Once unseated, the card cannot effectively be reattached since the glue is no longer molten or fluid. Likewise, during subsequent handling of the carrier web, if the card is unseated there is no readily available means to reposition the card on the carrier.

According to the present invention, an identification card assembly, and a method of manufacture of identification cards, are provided which avoid the problem discussed above. According to the present invention, when the ID card is removed from the carrier sheet by the ultimate customer, it is stripped from a layer of repositional adhesive (such as Cleantac™ adhesive sold by Moore Business Forms, Inc. of Lake Forest, Ill.), essentially no repositional adhesive sticking to the card. Since the card is thus entirely plastic (or paper), with no adhesive components, even during use it cannot become sticky.

According to one aspect of the present invention an identification card assembly is provided. The assembly comprises the following components: A plurality of identification cards each having top and bottom faces. Indicia imaged on each card top face. And, an intermediate carrier for the cards, comprising: a release material web; permanent adhesive disposed on a first face of the release material web; stock operatively disposed on the permanent adhesive, a first face of the stock operatively engaging the permanent adhesive, and the stock having a second face; and a repositional adhesive operatively associated with the stock second face, the repositional adhesive engaging the cards. The repositional adhesive has greater affinity for the card than the permanent adhesive has for the release material web, and the repositional adhesive has greater affinity for the stock second face than for the card.

In the assembly described above, a tie coat may be provided between the repositional adhesive and the stock second face to enhance adherence of the repositional adhesive to the stock. The stock is preferably paper, or clear Mylar or vinyl label stock, while the cards are preferably plastic. The permanent adhesive, stock, tie coat, and repositional adhesive are provided in spaced discrete areas on the release material web, only under each of the cards, and the release material web may be wound up into a roll configuration.

According to another aspect of the present invention an ID card assembly is provided comprising the following elements: A carrier sheet having first length and width dimensions and a top face. Permanent adhesive disposed on the carrier sheet top face. Stock having top and bottom faces, the stock bottom face operatively connected to the permanent adhesive. Repositional adhesive operatively connected to the stock top face. An ID card having top and bottom faces. Indicia provided on the ID card top face, and the ID card bottom face engaging the repositional adhesive. And, the permanent adhesive, stock, repositional adhesive, and ID card having second length and width dimensions, both significantly less than the first dimensions, and the repositional adhesive having greater affinity for the stock, and the permanent adhesive having greater affinity for the carrier sheet, than the repositional adhesive has for the card bottom face.

In the assembly described above a tie coat can be provided between the repositional adhesive and the stock, and the carrier sheet may be provided as part of a mailer type business form, with the ID card contained within the mailer. A plurality of ID cards may be connected to the carrier sheet, and spaced from each other therealong, each ID card having repositional adhesive, stock, and permanent adhesive, of the second dimensions, associated therewith.

Yet another aspect of the present invention is a method of making ID cards. The method comprises the following steps: (a) Imaging indicia on at least a top face of a web of ID card material. (b) Laminating the web of ID card material to a web of release material, using a web of stock material connected to the web of release material by permanent adhesive, and repositional adhesive connecting the ID card material to the stock material, to provide a composite web. After steps (a) and (b) substantially sequentially: (c) Die cutting the composite web to form discrete ID cards. (d) Stripping matrix material from the composite web to provide ID cards spaced from each other along the release material web. (e) Rolling up the release material web into a roll configuration. (f) Taking the ID cards, with connected repositional adhesive, stock, and permanent adhesive, from the web of release material and positioning them on a carrier sheet so that at least one ID card is on a carrier sheet, and so that multiple cards on a carrier sheet are spaced from each other. And, (g) variably imaging indicia on the top face of the ID card or cards on the carrier sheet.

Step (g) is preferably practiced using a non-impact printer, and step (a) may be practiced by imaging both the top and bottom face of the web of ID card material. Step (f) may be practiced by blowing on or tipping on, and step (b) is typically practiced by providing a tie coat between the repositional adhesive and the stock. The carrier sheet may be in the form of a continuous web, in which case there is the further step of separating the continuous web into discrete sheets. Each of the discrete sheets may be formed into a mailer type business form, with a single ID card contained within the mailer.

It is the primary object of the present invention to provide an advantageous ID card assembly, and method of making ID cards. This and other objects of the invention will become clear from an inspection of the detailed description of the invention, and from the appended claims.

DETAILED DESCRIPTION OF THE DRAWINGS

Figure 1:
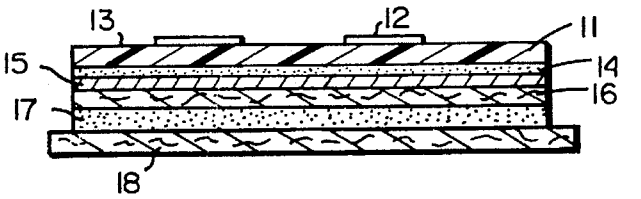
FIG. 1 is a cross-sectional view, with the components greatly enlarged for clarity of illustration, of an ID card assembly intermediate according to the present invention.

An intermediate ID card assembly according to the present invention is shown generally by reference numeral 10 in FIG. 1. It includes an ID card 11, which preferably is made of plastic but also can be made of paperboard, paper or like sheet material, with indicia 12 imaged on the top face 13 thereof. The term "ID card" in the present specification and claims is used generically, and includes cards used for discounts at retail establishments, club cards, check cashing cards, credit cards, and the like.

Figure 4:
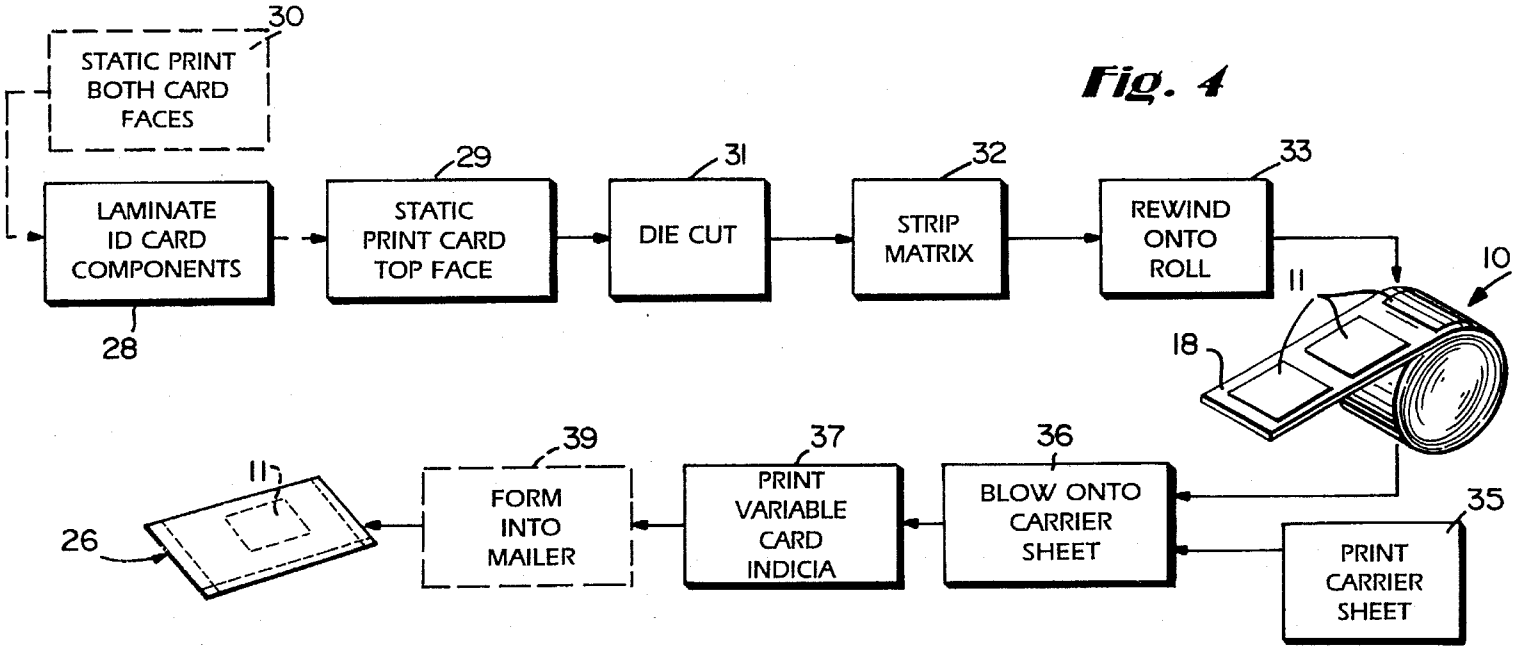
FIG. 4 is a schematic view illustrating various method steps that may be used in the practice of an exemplary method according to the invention.

Connected to the bottom face (22—see FIGS. 2 and 3) of the card 11, as shown in FIG. 1, is a layer of repositional adhesive 14 having substantially the same dimensions as the card 11. The repositional adhesive 14 may be any conventional repositional adhesive, such as Cleantac™ adhesive sold by Moore Business Forms, Inc. of Lake Forest, Ill. A conventional tie coat (e.g. pigment and binder) 15 may be provided for positively and securely attaching the repositional adhesive 14 to stock material 16. The stock material preferably comprises label stock material, such as Fasson's Ultralight, product no. 02120. The permanent adhesive 17 and release liner material 18 are operatively associated with the label stock 16. The Fasson Ultralight product includes the permanent adhesive 17 and the release liner 18 therewith, the paper face stock 16 comprising about 50 pound stock, the release liner 18 about 35 pound stock, and the adhesive 17 is typically AT564. The intermediate assembly 10 may be in a roll configuration, as illustrated in FIG. 4, with individual cards 11 spaced from each other along the release material web 18, constructed in a manner which will be described later.

Figure 2:
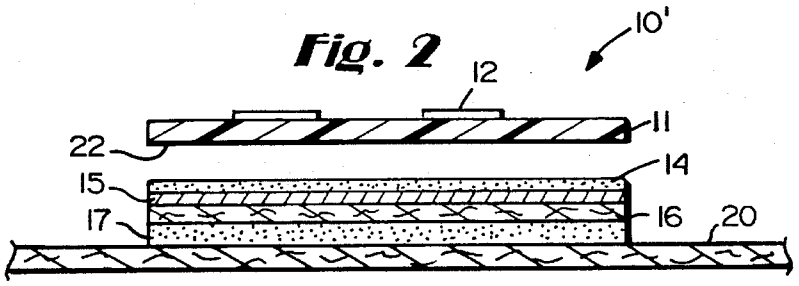
FIG. 2 is a view like that of FIG. 1 only for an ID card final assembly according to the invention, with the ID card itself shown disconnected from the repositional adhesive which attaches it to the carrier web.
Figure 3:
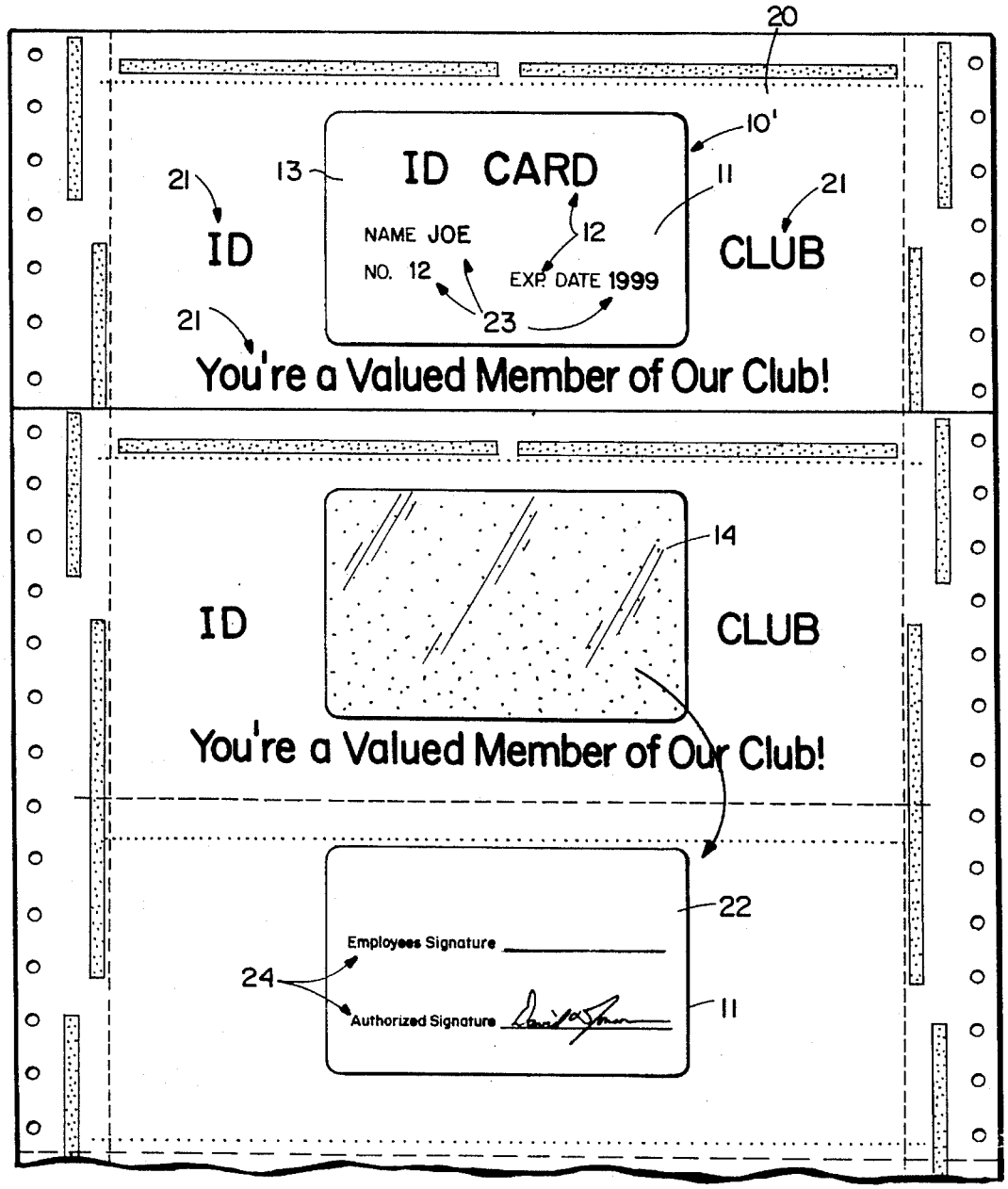
FIG. 3 is a top plan view of the assembly of FIG. 2, with one of the ID cards shown removed from the carrier web, and illustrating the back thereof.

The intermediate 10 of FIG. 1 is used to construct the assembly 10' illustrated in FIGS. 2 and 3. The release material 18 is removed from the permanent adhesive 17, the release material 18 having less affinity for the permanent adhesive 17 than the ID card 11 has for the repositional adhesive 14. The permanent adhesive 17 then is brought into contact with the top face of a carrier sheet 20 which has dimensions much greater than those of the card 11 and associated adhesives 14, 17, label stock 16, and tie coat 15. The carrier sheet 20 typically is paper and may have human readable indicia 21 imaged on a top face thereof.

The assembly in the form 10', having the permanent indicia 12 imaged thereon, is typically passed through a non-impact printer to print variable indicia such as variable indicia 23 illustrated in FIG. 3. Also the bottom face 22 of the ID card 11 can have static indicia imaged thereon, as indicated by 24 in FIG. 3 for the bottom card.

As seen for the bottom card in FIG. 3, the card 11 may be readily removed from the carrier sheet 20 by the ultimate consumer merely by grasping an edge of the card 11 and pulling it upwardly. The bottom face 22 of the card 11 completely detaches from the repositional adhesive 14, and essentially no repositional adhesive 14 remains thereon since the repositional adhesive 14 has a greater affinity for the tie coat 15 (and thus label stock 16) than for the card 11.

FIG. 4 schematically illustrates a typical method of manufacture of the assembly 10', which may then also be constructed into several final forms. For example the assembly 10' may be further acted upon by cutting the carrier sheet 20 into individual carrier components each having only a single ID card 11 associated therewith, and that may either be given to an ultimate customer, or mailed in an envelope. Alternatively, a carrier sheet 20 (with only one ID card 11 associated therewith) may be folded and adhesively secured into a conventional mailer type business form assembly, such as shown schematically by reference numeral 26 in FIG. 4.

In the exemplary method steps of FIG. 4, the ID card components are laminated together at stage 28. That is a web of card material 11 is laminated to the repositional adhesive coating 14, tie coating 15, and a web of label stock 16, the label stock 16 including permanent adhesive 17 and release material web 18. As indicated at stage 29, the top face 13 of the ID card 11 web of material may then be printed with static indicia. Alternatively, as indicated in dotted line at 30 in FIG. 4, static printing may be provided on the ID card material web 11 (either just the top face 13 or both the top and bottom faces 13, 22) prior to the lamination stage 28.

After the ID card components have been laminated together, and printed, the printing typically taking place on a Webtron 1600 press, the die cutting stage 31, the matrix stripping stage 32, and the winding stage 33 are practiced—typically on the press. The die cutting stage 31 is to cut all of the components 11 through 17 into discrete elements having the desired size for a final single ID card, while the web 18 is not cut but provides a continuous substrate. The components outside of the final card 11 and associated layers are then stripped off as matrix material at stage 32. Typically the web 18 is many cards 11 wide, in which case it is also slit before being wound into rolls as indicated at 33, a typical roll 10 being seen in FIG. 4.

At the same time that the stages 28 through 33 are being practiced, the carrier sheet (in either web or cut sheet form) may be printed (e.g. with the indicia 21) as indicated by stage 35 in FIG. 4. The roll 10 is then combined with the carrier sheet 35 using a conventional machine for blowing or tipping on at stage 36. Then the carrier sheet 20—in either web or cut sheet configuration—is passed through a conventional non-impact (e.g. laser) printer as indicated at stage 37, where the variable information 23 is printed (imaged). If the carrier sheet 20 is in web form, individual cut sheets are formed by conventional cutting mechanisms, so that one ID card 11 is associated with each cut sheet. If desired, the carrier sheet 20 (if it has dimensions large enough to accomplish it, and it has adhesive strips associated therewith) may be formed into a mailer as indicated at stage 39, utilizing conventional techniques, the formed mailer 26 being schematically illustrated in FIG. 4. Note that the ID card 11, shown in dotted line in FIG. 4, is completely contained in the interior of the mailer 26.

When the ID card 11 is accessed by the ultimate consumer, he or she merely removes it from the repositional adhesive 14 and places it into his or her wallet, card case, or the like. Since the card 11 cleanly separates from the repositional adhesive 14, there is no stickiness associated with it even if it is heavily used.

It will thus be seen that according to the present invention an advantageous identification card assembly, and method of making ID cards, have been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent products and processes.

What is claimed is:

1. An ID card assembly, comprising:

a carrier sheet having first length and width dimensions and a top face;

permanent adhesive disposed on said carrier sheet top face;

stock having top and bottom faces, said stock bottom face connected to said permanent adhesive;

repositional adhesive operatively connected to said stock top face;

an ID card having top and bottom faces;

indicia provided on said ID card top face, and said ID card bottom face engaging said repositional adhesive; and said permanent adhesive, stock, repositional adhesive, and ID card having second length and width dimensions, both significantly less than said first dimensions, and said repositional adhesive having greater affinity for said stock, and said permanent adhesive having greater affinity for said carrier sheet, than said repositional adhesive has for said card bottom face.

2. An ID card assembly as recited in claim 1 further comprising a tie coat between said repositional adhesive and said stock.

3. An ID card assembly as recited in claim 1 wherein said stock is paper label stock, and wherein said ID card is plastic.

4. An ID card assembly as recited in claim 1 wherein said carrier sheet is paper.

5. An ID card assembly as recited in claim 4 wherein said carrier sheet is part of a mailer business form, and wherein said ID card is contained within said mailer.

6. An ID card assembly as recited in claim 1 further comprising a plurality of ID cards connected to said carrier sheet, and spaced from each other therealong, each ID card having repositional adhesive, stock, and permanent adhesive of said second dimensions associated therewith.

7. An ID card assembly as recited in claim 2 wherein said stock is paper label stock, and wherein said ID card is plastic.

8. An ID card assembly as recited in claim 2 wherein said carrier sheet is paper.

9. An ID card assembly as recited in claim 8 wherein said carrier sheet is part of a mailer business form, and wherein said ID card is contained within said mailer.

10. An ID card assembly as recited in claim 2 further comprising a plurality of ID cards connected to said carrier sheet, and spaced from each other therealong, each ID card having reposition adhesive, stock, and permanent adhesive of said second dimensions associated therewith.

11. An ID card assembly as recited in claim 3 wherein said carrier sheet is paper.

12. An ID card assembly as recited in claim 11 wherein said carrier sheet is part of a mailer business form, and wherein said ID card is contained within said mailer.

13. An ID card assembly as recited in claim 3 further comprising a plurality of ID cards connected to said carrier sheet, and spaced from each other therealong, each ID card having repositional adhesive, stock, and permanent adhesive of said second dimensions associated therewith.

14. An ID card assembly as recited in claim 11 further comprising a plurality of ID cards connected to said carrier sheet, and spaced from each other therealong, each ID card having repositional adhesive, stock, and permanent adhesive of said second dimensions associated therewith.

15. An ID card assembly as recited in claim 12 further comprising a plurality of ID cards connected to said carrier sheet, and spaced from each other therealong, each ID card having repositional adhesive, stock, and permanent adhesive of said second dimensions associated therewith.

16. An ID card assembly as recited in claim 4 further comprising a plurality of ID cards connected to said carrier sheet, and spaced from each other therealong, each ID card having repositional adhesive, stock, and permanent adhesive of said second dimensions associated therewith.

17. An ID card assembly as recited in claim 5 further comprising a plurality of ID cards connected to said carrier sheet, and spaced from each other therealong, each ID card having repositional adhesive, stock, and permanent adhesive of said second dimensions associated therewith.

* * * * *